US005413646A

United States Patent [19]

Dash et al.

[11] Patent Number: 5,413,646

[45] Date of Patent: May 9, 1995

[54] HEAT-TREATABLE CHROMIUM

[75] Inventors: John Dash, Portland; John DeHaven, Aloha, both of Oreg.

[73] Assignee: Blount, Inc., Montgomery, Ala.

[21] Appl. No.: 33,635

[22] Filed: Mar. 16, 1993

Related U.S. Application Data

[63] Continuation-in-part of Ser. No. 653,022, Feb. 8, 1991, Pat. No. 5,194,100.

[51] Int. Cl.[6] ..... C25D 3/06; C25D 3/56; C25D 5/50

[52] U.S. Cl. ..... 148/518; 204/227; 204/243 M; 204/259; 204/287; 204/289

[58] Field of Search ..... 205/227, 243, 287, 255, 205/259, 289; 148/518

[56] References Cited

U.S. PATENT DOCUMENTS

| | | | |
|---|---|---|---|
| 3,771,972 | 11/1973 | Schoer et al. | 29/196.6 |
| 3,909,372 | 9/1975 | Fujii | 204/51 |
| 3,917,517 | 11/1975 | Jordan et al. | 204/43 P |
| 3,951,759 | 4/1976 | Studer | 204/32.1 |
| 3,954,574 | 5/1976 | Gyllenspetz et al. | 205/287 X |
| 4,447,299 | 5/1984 | Kasaaian et al. | 204/43 |
| 4,460,438 | 7/1984 | Tardy et al. | 205/287 X |
| 4,612,091 | 9/1986 | Benaben et al. | 205/287 |
| 4,615,773 | 10/1986 | Dash et al. | 204/43.1 |
| 4,690,735 | 9/1987 | Laitinen et al. | 204/37.1 |

OTHER PUBLICATIONS

Dash et al., "Plating of Heat-Treatable Hard Chromium from a Trivalent Bath", AESF Summer Fellowship Project #1, Toronto SUR/FIN '91, International Technical Conference Proceedings, Session Q-Research (Jun. 24–27, 1991).

Kasaaian and Dash, "Effect of Methanol and Formic Acid on Chromium Plating, " *Plating and Surface Finishing* 71:66–73 (1984).

Dash and DeHaven, "Plating of Heat Treatable Hard Chromium," *Plating and Surface Finishing*, p. 39 (Nov. 1989).

Hoshino et al., "The Electrodeposition and Properties of Amorphous Chromium Films Prepared from Chomic Acid Solutions," *J. Electrochem. Soc.* 133:681–685 (1986).

Hyashi, "From Art to Technology: Developments in Electroplating in Japan," *Plating and Surface Finishing* 30–41 (Sep. 1991).

*Primary Examiner*—John Niebling
*Assistant Examiner*—William T. Leader
*Attorney, Agent, or Firm*—Klarquist Sparkman Campbell Leigh & Whinston

[57] ABSTRACT

A method for depositing chromium and iron metals on substrates is disclosed in which the chromium hardens when heated. The electrolytic plating bath preferably includes: (a) water soluble Cr(III) produced by reducing Cr(VI) with sufficient amounts of methanol or formic acid; (b) ammonium formate; (c) a sulfate catalyst, such as sodium sulfate; (d) an inorganic iron compound, such as iron sulfate; (e) sufficient amounts of boric acid to substantially saturate the bath; and (f) a sufficient amount of sulfuric acid to provide a bath pH of from about 1.0 to about 1.5. The heat-hardenable chromium deposit allows the plated substrate to be heat tempered after plating to provide a KHN of greater than about 1200. This eliminates the necessity of removing oxidation products from an unplated heated substrate. Moreover, the amount of toxic Cr(VI) present in the bath is greatly diminished, and is replaced with a Cr(III) species that is environmentally safer. Electrolytic plating baths of the present invention having ammonium formate and a total sulfate concentration of about 140 g/L to about 180 g/L produce chromium and iron metal deposits on substrates having thicknesses of up to about 160 μm. Moreover, the iron content of the deposit can be varied over a range of from about 10% to about 90% by adjusting the sulfate-to-iron ratio in the plating bath.

28 Claims, 10 Drawing Sheets

HEAT-TREATABLE CHROMIUM

CROSS-REFERENCE TO RELATED APPLICATION

This application is a continuation-in-part of U.S. patent application Ser. No. 07/653,022, filed on Feb. 8, 1991 (parent application) now U.S. Pat. No. 5,194,100. The parent application is incorporated herein by reference.

FIELD OF THE INVENTION

This invention concerns a trivalent chromium plating bath and method for using the bath to plate workpieces. More specifically, the method comprises plating substrates with varying percentages of chromium and iron metals wherein the plated metals may have a thickness of up to about 160 μm.

BACKGROUND OF THE INVENTION

Many types of electrolytic plating solutions have been developed to deposit chromium electrochemically on a metal substrate. One of the most widely used solutions contains predominantly hexavalent chromium ions [Cr(VI)] in the form of dissolved chromium trioxide ($CrO_3$). Chromium trioxide is mixed with water and a sulfate catalyst to produce a plating bath that provides a lustrous protective or decorative chromium plate.

It has long been known that a predominantly hexavalent chromium ion solution produces a brighter, more lustrous, thick-plated product than a trivalent solution. Moreover, significant amounts of trivalent chromium have been considered an undesirable contaminant in chromium electroplating solutions.

More recently, U.S. Pat. Nos. 4,447,229 and 4,615,773 disclosed electrolytic plating bath solutions that contained both trivalent and hexavalent chromium. The current efficiency of these electroplating processes was improved by adding small amounts of methanol to a bath containing dissolved $CrO_3$ electrolyte. This bath promoted rapid electrodeposition of a chromium plate with greater uniformity of the plated product. Particularly good current efficiency was observed when the bath contained dissolved metallic ions, such as iron. Current efficiency also was enhanced by maintaining the pH at the cathode at about 2.0 with a metal ion buffer.

Although chromium plating processes have long been known, the versatility of industrial processes using such plating generally has been limited because chromium softens when heated. Such heat softening is a particular problem in production processes that plate chromium on a heat-hardenable substrate, such as an alloy steel. In the production of cutter elements, for example, it is necessary to heat-harden an alloy steel substrate before electrochemically plating the substrate with chromium. This avoids softening the chromium during a heat treatment step. Moreover, the surface of the steel substrate oxidizes when heated and must be thoroughly cleaned with a caustic material or other cleaning agents prior to plating. If such a cleaning step is not performed prior to plating, the chromium metal does not adhere well to the underlying steel substrate. Hence, the necessity of heating the substrate prior to plating introduces an additional costly step into the manufacturing process.

Another drawback to conventional electrodeposited chromium plate is that hydrogen is evolved at the cathode and incorporated into the chromium metal. Hydrogen can then diffuse from the plated metal into an alloy steel substrate, thereby embrittling the metal alloy. The plated chromium can be heated to 500°-650° C. to evolve hydrogen, thereby avoid such embrittlement, but such heating unacceptably softens the chromium plate. Lower heat treatment temperatures can avoid chromium softening, but require prolonged periods of heating. Hence, prevention of hydrogen embrittlement of the substrate cannot be avoided by heat treatment without concomitantly sacrificing hardness of the chromium plate or prolonging the manufacturing process.

Another drawback associated with trivalent chromium plating processes is that the thickness of the deposited chromium layer has been limited from about 2 μm to about 5 μm. For instance, previous processes employing trivalent chromium have been found to produce chromium layers having a thickness of approximately 3 μm. Where a chromium layer greater than about 3 μm is required, conventional trivalent plating processes have not been able to produce the desired thickness.

Yet another problem encountered in chromium electroplating is that conventional electrolytic baths contain high concentrations of hexavalent chromium ions. Hexavalent chromium ions are extremely toxic. The disposal of hexavalent chromium is subject to strict and costly environmental regulations that greatly increase the expense of electroplating processes.

A final problem associated with previous plating solutions is the inability to plate a substrate with varying percentages of iron and chromium. Hence, it would be helpful to have a plating bath that eliminates the use of hexavalent chromium, produces a heat-treatable substrate coating, and can deposit chromium and iron metal layers having thicknesses of greater than about 50 μm. Such a bath has not been described prior to the present invention.

SUMMARY OF THE INVENTION

The foregoing problems have been overcome by providing an aqueous electrolytic plating bath that contains trivalent chromium ions, but is preferably substantially free of hexavalent chromium ions. Chromium metal is electroplated from this bath onto a substrate. One example of a substrate suitable for the present invention is a cutter. The plated substrate then is heated to increase the hardness of the substrate. In preferred embodiments, heating temperatures are chosen that harden the chromium as well as the substrate.

The process of the present invention has both environmental and manufacturing advantages. Avoiding or reducing the concentration of hexavalent chromium ions simplifies complying with environmental regulations which require specialized disposal of hexavalent chromium as a toxic waste. The heat-treatable chromium also permits heat treatment of steel substrates, such as cutters, which already have been plated, thereby avoiding the manufacturing step of cleaning oxidation products off bare steel substrates which are heat treated before plating. Finally, heat treating substrates may improve adhesion of chromium metal to the substrate because mutual molecular diffusion can occur between the chromium and steel layers during heating.

In especially preferred embodiments of the invention, a plating composition is prepared by reducing with, for example, methanol or formic acid a water-soluble hexavalent chromium compound, such as $CrO_3$, substantially completely to trivalent chromium. To achieve substantial reduction of all hexavalent chromium in a conventional bath, the amount of methanol should be about 80 ml/liter, or about 3 grams $CrO_3$ to 1 ml methanol. A preferred concentration of Cr(III) in the composition is from about 28 g/L to about 35 g/L.

A water-soluble iron compound and sulfuric acid also are preferably added to the solution. These compounds apparently help buffer the pH to between 0.5 and 2.0, and more preferably between 1.0 and 1.5. If the pH at the cathode rises above about 2.0, iron will precipitate as $Fe(OH)_3$. A preferred embodiment of the invention provides a plating composition having about 10 to about 12 g/L iron, wherein the iron is supplied by a water-soluble inorganic iron compound such as iron sulfate.

A sulfate catalyst is preferably added to the solution in a ratio of at least about 1:1 by concentration of sulfate to trivalent chromium ion. Sulfate ion apparently facilitates the reaction at the cathode. In a preferred embodiment of the invention for depositing metal layers having thicknesses of up to about 160 μm, sodium sulfate is added to the bath at a concentration of from about 35 g/L to about 60 g/L, more preferably about 37 g/L. Sodium sulfate concentrations within this range, along with other sources of sulfate ion such as sulfuric acid and iron sulfate, provide a total plating-bath sulfate concentration of from about 140 g/L to about 180 g/L, and even more preferably about 165 g/L. Surprisingly, it has been found that adding ammonium formate to the bath and increasing the total sulfate concentration to about 165 g/L using sodium sulfate, enables the composition to plate substrates with metal layers as thick as about 160 μm. Sources of sulfate ion other than sodium sulfate also may be used, although other sources, such as potassium sulfate, are not as preferred as sodium sulfate.

The bath also preferably contains ammonium formate ($NH_4CO_2H$) and boric acid ($H_3BO_3$). In a preferred embodiment, ammonium formate is added to the bath at a concentration of from about 21 g/L to about 26 g/L, even more preferably about 23 g/L to about 24 g/L. A sufficient amount of boric acid is added to substantially saturate the bath.

The heat treatment step preferably involves heating the plated alloy steel substrate to 600°-1000° C., then reducing the temperature to a lower temperature. A preferred temperature for heating thick deposits is about 600° C. Heating deposits to about 600° C. generally increases the KHN to greater than about 1200. In especially preferred embodiments for plated thicknesses of less than about 25 μm, the plated substrate is austempered without reducing the hardness of the chromium plate by heating the plated substrate to at least about 6°-700° C., preferably about 900° C., followed by rapid quenching in molten salt at about 270° C. The quenched substrate is held at this lower temperature for a sufficient period of time to harden the substrate. This period of time is typically about one hour.

As stated above, a water-soluble inorganic iron compound is preferably added to the plating composition. It has been found that iron is plated easier from a trivalent chromium bath than is chromium itself. Hence, the present invention also provides a method for plating substrates, such as cutter elements, with varying amounts of chromium and iron metals. Thus, by adjusting the ratio of iron and chromium in the plating composition, a concomitant plating layer can be plated upon the substrate. For instance, a substrate can be plated with stainless steel, which typically comprises at least about 12% chromium. A preferred amount of chromium for plating substrates, such as cutter elements, is typically between about 60% to about 90%. If the percentage of chromium drops below about 60%, then the plated substrate is not suitably hardened by heat treatment.

In other embodiments, electrolytic plating is performed with an anode made of a non-reactive material, such as platinum and/or carbon, that does not oxidize Cr(III) to Cr(VI) as easily as conventional lead anodes. A preferred anode for the present invention is a graphite rod, which minimizes the oxidation of Cr(III) to Cr(VI). Furthermore, substituting graphite electrodes for lead electrodes eliminates lead, which is an undesirable heavy metal. Electroplating is preferably performed by providing electrical current in pulses, such as at one-half or one hertz pulses. Providing electrical current in pulses appears to improve plating uniformity and the adherence of the deposits to the plated workpiece. Electroplating also is preferably performed with a current density of from about 0.8 to about 6.5 amperes per square inch, preferably about 0.8 to about 2.4 amperes per square inch, most preferably about 0.8 to about 2.0 amperes per square inch. The temperature of the plating bath is typically about 20° C. to about 30° C., although it is likely possible to achieve good plating results at temperatures well below these values. The pH of the bath also appears to be important for achieving good quality deposits. The pH is preferably from about 0.5 to about 1.5, more preferably from about 1.0 to about 1.5, and even more preferably about 1.25.

It is an object of this invention to provide a process for electrolytic deposition of chromium that is environmentally safer than previous processes.

It is an object of the present invention to provide a process for electrolytic deposition of chromium and iron that can deposit layers having a thickness up to about 160 μm while maintaining end product quality.

Another object of the present invention is to provide a process for plating a substrate with various ratios of chromium metal to iron metal using a bath that is environmentally safer than predecessor compositions.

Another object of the invention is to provide such a process that eliminates the necessity for cleaning oxidation products produced by heating a substrate before electroplating.

Yet another object is to provide a process that produces chromium plated workpieces that harden or maintain their hardness when heated, and display excellent wear characteristics.

Finally, it is an object of the invention to provide a product having superior adhesion between the chromium plate and underlying substrate.

These and other objects of the invention will be understood more clearly by reference to the following detailed description and drawings.

DETAILED DESCRIPTION OF PREFERRED EMBODIMENTS

Conventional processes for making chromium plated workpieces, such as cutters, begins by forming a substrate, typically alloy steel, into the desired form. The formed substrate is then degreased and hardened by an austempering process in which the substrate is first heated briefly at a first temperature and then immersed in a molten salt at a lower, second temperature wherein the second temperature is preferably less than about 350° C. One skilled in the art will realize that the preferred heating process for a plated workpiece depends in great part upon the expected use for the workpiece. For instance, if the workpiece is stainless steel and it is desired to harden both the steel substrate and the coating, then the composite structure should be heated to about 800° C. before it is quenched. However, if just the chromium plating needs to be hardened, then it may be sufficient to heat the composite from about 600° C. to about 700° C., preferably about 600° C. before cooling at the second temperature.

However, in general the heat hardening step comprises heating the plated substrate to a first temperature of from about 600° C. to about 1000° C., and then immersing the heated substrate in molten salt at a second, lower temperature of preferably less than about 350° C. The rate of decrease in temperature between the higher temperature and molten salt environment is important. A relatively quick quench on the order of one second, for example, provides excellent hardening of the steel substrate. During the heat-hardening step, the surface of the alloy steel substrate is covered by oxidation products which must be removed by rinsing and vigorous cleaning. After cleaning, the substrate then is placed in an electroplating vessel which contains an aqueous solution of hexavalent chromium. Reverse electrical current is supplied briefly through the solution to clean the surface of the cutters, then the polarity is reversed. Direct electrical current then is supplied to plate the substrate with a thin covering of chromium. If the coated chromium workpieces are cutters, they are next rinsed, shot peened, ground and assembled if required.

In the method of the present invention, the substrate is formed into a workpiece and degreased. Instead of heat-hardening the bare substrate, however, the substrate is directly plated with chromium metal from a Cr(III) bath that is substantially free of Cr(VI). The plated workpiece then is heat-hardened, which removes hydrogen from the chromium metal and thereby diminishes hydrogen embrittlement of the steel workpiece. The necessity for cleaning oxidized by-products from the surface of the substrate also is eliminated because heating occurs after electroplating. Heating of the already electroplated substrate is made possible by providing a chromium plate which retains or increases its hardness when heated.

Figure 1:
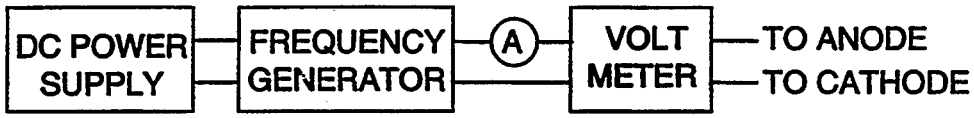
FIG. 1 is a schematic drawing of a circuit useful for plating substrates according to the present invention.
Figure 2:
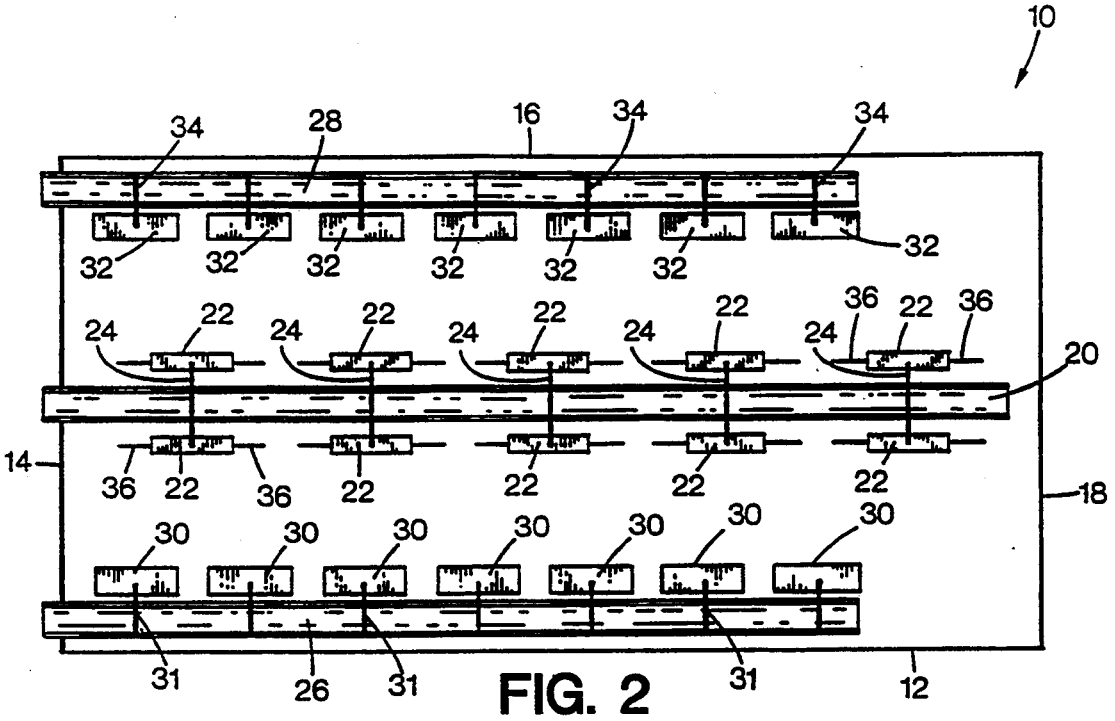
FIG. 2 is a top plan schematic view of a particular electroplating vessel constructed in accordance with the present invention.

FIG. 1 schematically illustrates a circuit useful for plating substrates according to the present invention. FIG. 2 schematically illustrates a particular electroplating vessel useful for plating substrates, particularly cutter elements. Electroplating vessel 10 has sidewalls 12, 14, 16, 18 with internal faces that are plastic coated. An electrically conductive cathode support member 20 extends longitudinally across vessel 10 and supports a series of plastic coated holders 22 which are suspended from member 20 by electrical conductors 24. A pair of parallel, electrically conductive anode support members 26, 28 extends longitudinally across vessel 10 adjacent sidewalls 12, 16. Member 26 supports a series of anodes 30, each of which is suspended from member 26 by an electrical conductor 30. Member 28 similarly supports a series of anodes 32 suspended from electrical conductors 34.

Figure 3:
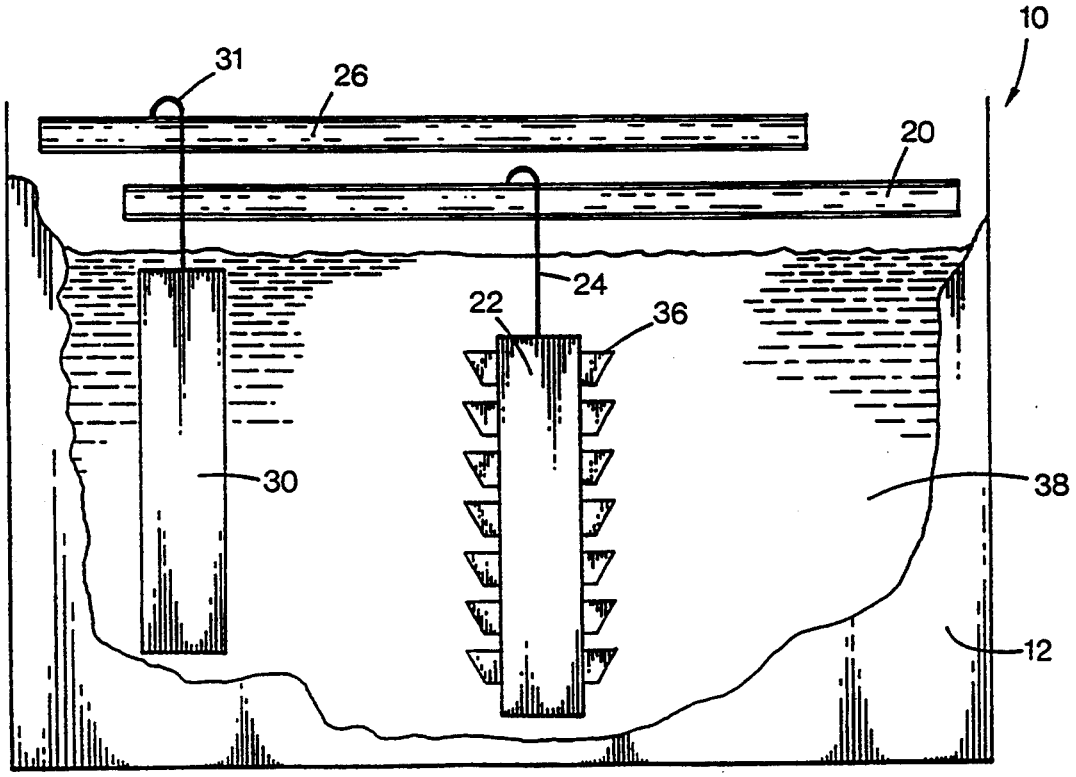
FIG. 3 is a side view of the electroplating vessel of FIG. 1, portions of the front sidewall of the vessel being broken away to illustrate the contents of the vessel, only one anode and one cathode being shown for clarity.

FIG. 3 schematically illustrates a single anode 30 and single holder 22 suspended in a vessel 10. Holder 22 is plastic coated to prevent the holder 22 from being plated. A series of exposed electrical conductors (not shown) are provided inside holder 22 to provide electrical current to substrates 36, such as cutters, during electroplating. A series of substrates 36 are placed in holder 22 in conductive contact with the exposed electrical conductors. A conventional source of electrical energy is supplied through cathode support member 20 and conductor 24. Substrates 36 serve as cathodic electrodes in the electrolytic plating process. Vessel 20 contains electroplating solutions 38 that are described in the following examples.

The electroplating solutions discussed in this application were analyzed by various analytical procedures to determine the content of the bath. These procedures include, without limitation, colorimetric, titrimetric, spectrophotometric, ion chromatography, and gravimetric analysis. The preferred methods for analyzing the plating bath for the various reagents are as follows: hexavalent chromium=colorimetric; trivalent chromium=spectrophotometric or colorimetric; sulfate=ion chromatography; and iron=gravimetric. Energy dispersive spectrometry (EDS) gives more rapid results but is not as accurate.

EXAMPLE I

Electroplating was performed in a vessel 20 containing 5 gallons of plating bath solution. The steel substrate was a cutter element such as that shown in U.S. Pat. No. 4,776,826. Each element had a plated surface area of 0.15 $in^2$ per item, which corresponded to the top and side plate of the cutter. The five-gallon electrolytic plating bath solution was prepared from a chromium electrolyte by combining 3.2 kg $CrO_3$, water and a suitable sulfate catalyst in vessel 10. 800 mls of methanol were added to substantially completely reduce Cr(VI) to Cr(III). The addition of methanol was followed by addition of 3.8 g of $H_2SO_4$ and 560 g of $FeSO_4.7H_2O$ as a source of metal ion buffer. The source of metal ion, such as iron, may be other than iron sulfate. For instance, iron chloride may be substituted for iron sulfate; however, chloride ions are not as environmentally acceptable as sulfate ions. The final composition of the bath is given in Table 1 below:

TABLE 1

| | Amount (Ounces/Gallon) |
|---|---|
| Trivalent Chromium | 6.8 |
| Hexavalent Chromium | 2.8 |
| Iron | 0.76 |
| Sulfate | 25.4 |

After mixing and stabilization with the metal ion buffer, the pH was 1.2. Twenty-four samples of an alloy steel cutter substrate 36 were placed in rack 22 and electroplating was performed with a current density of about 0.5 to 0.8 amperes per square inch. The average current density of one run was 0.69 amperes per square inch with an average plating speed of 9.0±2.0 micro inches per minute. In a second run the average current density was 0.5 amperes per square inch with an average plating speed of 7.8 micro inches per minute. These low current densities minimized roughness on the curved substrates, but are not essential to making a hardenable chromium plate. The temperature of solution 38 was maintained at 65° F.±3° F. without agitation during electroplating.

EXAMPLE II

The effect of heating the chromium plate was determined by performing microhardness tests on the chromium deposits in the as-plated condition and after two different types of heat treatments. In the first heat treatment test, twenty-four plated cutters were heated to 1675° F. for 20 minutes, immediately after which the cutters were transferred to a molten salt medium in which they were heated at 545° F. for 60 minutes. In a separate run, twenty-four plated cutters were heated at 1000° F. for 30 minutes and then cooled to room temperature with no further heat treatment. Results for these two types of heat treatment are given in Table 2 below. These results are compared to hardness of non-heat treated (as-plated) cutters. Hardness was determined by a conventional Knoop Hardness Machine in which a diamond shaped load weighing 25 g or 50 g was placed on a highly polished chromium plate, and then examined under a microscope. Results were expressed in terms of a Knoop Hardness Number (KHN).

TABLE 2

| Condition | | No. of Tests | KHN (25a load) Av. KHN | Range |
|---|---|---|---|---|
| As-plated | Cr Deposit | 5 | 1140 | 947–1310 |
| | Steel Substrate | 5 | 617 | 519–716 |
| Heated After Plating 1675° F. 20 min then 545° F. 60 min. | Cr Deposit | 4 | 1144 | 1044–1218 |
| | Steel Substrate | 4 | 691 | 569–848 |
| Heated After Plating 1000° F. 30 min | Cr Deposit | 3 | 1447 | 1409–1486 |
| | Steel Substrate | 3 | 835 | 785–889 |

The chromium plate maintained its hardness after heating at 1675° F. for 20 minutes and then at 545° F. for 60 minutes. The average Knoop hardness number (KHN) of the steel substrate actually increased from 617 to 691 in comparison to the unheated chromium plated substrate, even though the KHN of the chromium deposit did not change significantly. In contrast, when the freshly plated cutter was heated at 1000° F. for 30 minutes after plating, the average KHN of both the substrate and plate increased. The KHN of the chromium deposit increased from 1140 to 1447, while the average KHN of the steel substrate increased from 617 to 835.

The results described above demonstrate that chromium plated from the plating solution of the present invention retains or increases its hardness when heated.

Figure 4:
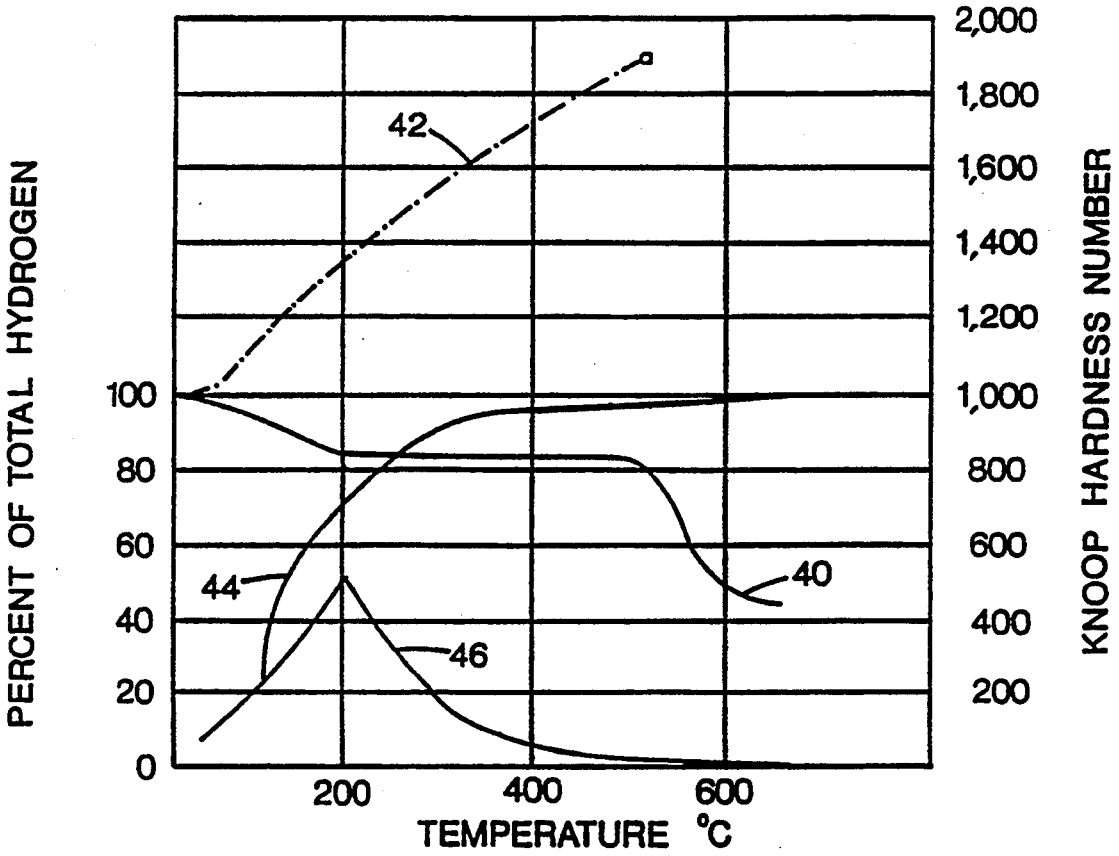
FIG. 4 is a graph showing variation in hardness and hydrogen content of electrodeposited chromium as a function of heat treatment temperature.

In contrast, chromium plate from a Cr(VI) bath softens when heated, as shown in the graph of FIG. 4. In that graph, line 40 indicates changes, with increasing temperature, in the hardness of chromium plated from a conventional hexavalent bath. Line 42 indicates hardness of chromium plating electrodeposited from the bath of Example I. Line 44 graphically represents the percent of total hydrogen evolved from a conventional Cr(VI) plating with increasing temperature, while line 46 represents the percent of total hydrogen evolved from such a plating at the indicated temperatures. Conventional Cr(VI) chromium deposit hardness decreases almost immediately with increasing temperature. At 540° C. (1000° F.) chromium deposited from a hexavalent bath has decreased appreciably in hardness, while chromium plated from the bath of Example I increases significantly after heating at that temperature. The chromium plated from the bath of Example I required heating to 913° C. (1675° F.) before its hardness was reduced to the as-plated KHN value. This was unexpectedly fortuitous because 913° C. is the temperature preferred for austempering the steel alloy substrate. Hence, plating from the bath of Example I allows austempering to occur after rather than before plating.

Numerous potential benefits follow from heat treating after plating. Cleaning is no longer required before plating to remove oxidation products produced by heating bare substrates. Hydrogen embrittlement of the steel substrate also is diminished because heating the chromium reduces the hydrogen content of the plated metal. Hydrogen embrittlement of the chromium deposit also is decreased by heating. Finally, bonding of the chromium plate to the underlying steel substrate may be improved by interdiffusion between the deposit and substrate at the elevated temperature required for austempering.

EXAMPLE III

Figure 5:
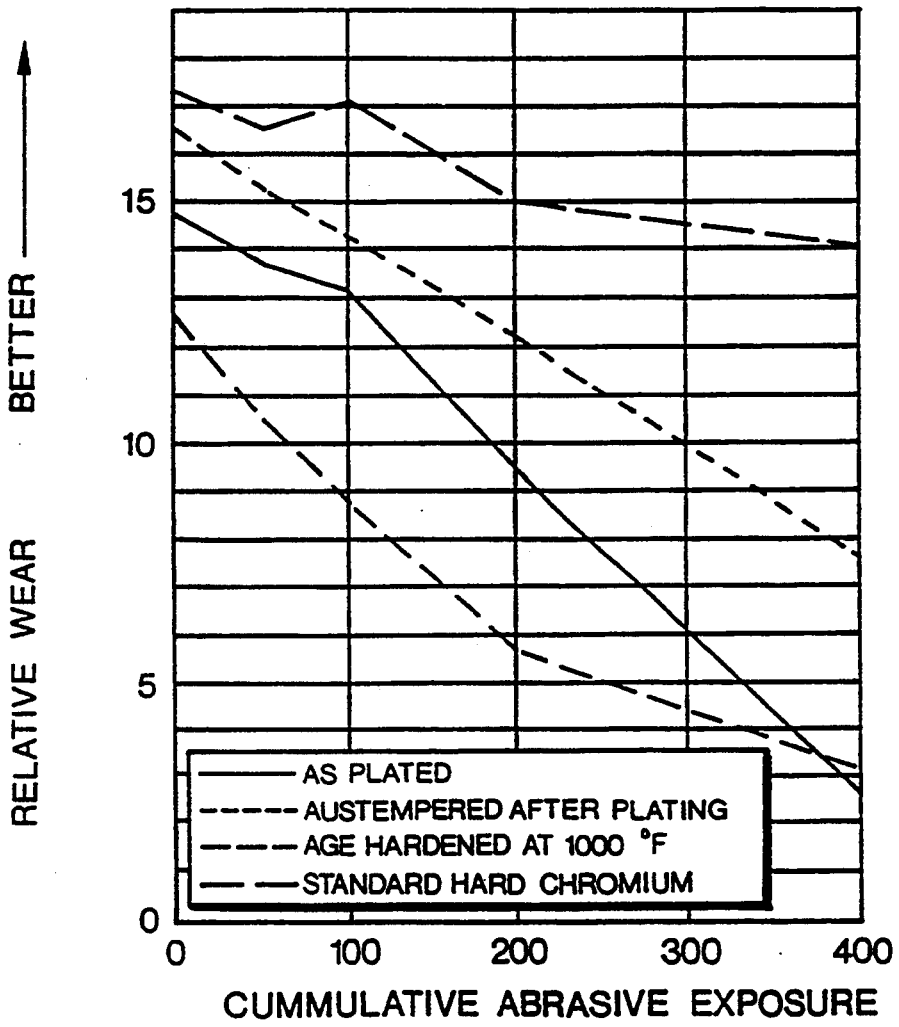
FIG. 5 is a graph showing the relative wear performance of chromium plating on a chain saw, comparing the performance of chromium plated from a Cr(VI) bath to heat treated and non-heat treated chromium from a Cr(III) bath.

The woodcutting properties of saw chains made of cutters plated with the bath of Example I were compared with saw chains which incorporated cutters plated from a conventional hexavalent chromium bath. The results of these comparisons are shown in FIG. 5, which illustrates that chromium plating from a conventional hexavalent electrolytic bath has excellent wear properties. The performance characteristics of chromium plated in the bath of Example I depended on the type of heat treatment to which the plating was subjected. Austempering after plating provided a product having properties superior to chromium plated from a trivalent bath that was not heat-treated. Plating from the trivalent bath that was age-hardened at 1000° F. had greater relative wear with cumulative abrasive exposure. Chromium plated from the bath of Example I but that was not heat treated had wear characteristics intermediate the austempering and age hardened samples.

EXAMPLE IV

The effect of varying the amperage of the electroplating current was studied in eighteen runs of 24 cutters plated with the bath of Example I. The temperature of the bath was maintained at 70° F. for all electroplatings in this study. Results are shown in Table 3.

TABLE 3

| SAMPLE NO. | TIME mins | VOLTAGE VOLTS | CURRENT AMPS | CURRENT DENSITY (amps/sq.in) | TEMP DEG F. | pH | THICKNESS MICRO-IN | DEPOSIT RATE |
|---|---|---|---|---|---|---|---|---|
| 1 | 30 | 6.1 | 3.5 | 0.9690 | 70 | 0.77 | | — |
| 2 | 30 | 7.5 | 5.0 | 1.3843 | 70 | 0.76 | | — |
| 3 | 30 | 7.0 | 3.5 | 0.9690 | 70 | 1.20 | 200 | 5.83 |
| 4 | 30 | 7.0 | 3.5 | 0.9690 | 70 | 1.20 | 175 | 5.83 |
| 5 | 40 | 6.0 | 2.5 | 0.6921 | 70 | | 50 | 1.56 |
| 6 | 53 | 6.0 | 2.5 | 0.6921 | 70 | | 120 | 2.12 |
| 7 | 40 | 7.3 | 3.5 | 0.9690 | 70 | | 120 | 3.75 |
| 8 | 55 | 7.3 | 3.5 | 0.9690 | 70 | | 250 | 4.55 |
| 9 | 50 | 8.4 | 4.5 | 1.2458 | 70 | | | — |
| 10 | 50 | 8.4 | 4.5 | 1.2458 | 70 | | | — |
| 11 | 50 | 6.3 | 3.0 | 0.8306 | 70 | | 200 | 4.50 |
| 12 | 50 | 6.3 | 3.0 | 0.8306 | 70 | | 100 | 2.75 |
| 13 | 60 | 5.0 | 2.5 | 0.6921 | 70 | | 175 | 3.96 |
| 14 | 60 | 5.0 | 2.5 | 0.6921 | 70 | | 200 | 3.33 |
| 15 | 60 | 5.6 | 3.5 | O.9690 | 70 | | 250 | 5.91 |
| 16 | 60 | 5.6 | 3.5 | 0.9690 | 70 | | 350 | 5.24 |
| 17 | 40 | 6.5 | 4.3 | 1.1905 | 70 | | | — |
| 18 | 36 | 6.5 | 4.3 | 1.1905 | 70 | | | — |

The degree of nodularity of the plate was sensitive to current density because lower current densities provided a smoother plated product having minimal nodularity. A current of 3.0–3.5 amperes yielded the most uniform coating. However, current densities between about 0.4 and 0.8 amperes per square inch of substrate plated were found to provide a particularly smooth product.

EXAMPLE V

The effect of heat treatment temperature on hardness of the chromium plate was further studied by electroplating chromium on alloy steel substrates using the solution described in Example I. Cutters were heat-treated in a pre-heated oven for one hour at the temperatures shown below, and deposit thickness was measured in the center of the plated cutter. The KHN values were measured with a Knoop Hardness Machine, and are shown in Table 4.

TABLE 4

| SAMPLE NUMBER | CR THICKNESS (MICRONS = IN) | TEMPERED AT (F.°) | FILAR UNITS (50 g) | KHN (50 g) | FILAR UNITS (25 g) | KHN (25 g) |
|---|---|---|---|---|---|---|
| 1 | 11.8 = 0.000456 | 525 | 132 | 1107 | 86 | 1310 |
| 2 | 8.0 = 0.000319 | 600 | 123 | 1275 | 70 | 1960 |
| 3 | 9.1 = 0.000358 | 700 | 120 | 1340 | 72 | 1860 |
| 4 | 8.6 = 0.000339 | 800 | 126 | 1220 | 74 | 1760 |
| 5 | 9.3 = 0.000366 | 900 | 120 | 1340 | 70 | 1960 |
| 6 | 8.2 = 0.000323 | 1000 | 113 | 1510 | 72 | 1860 |
| 7 | 8.3 = 0.000327 | *** | 143 | 944 | 97 | 1025 |

Chromium hardness was greater for all heat treated samples 1–6 as compared to untempered sample 7. Hardness was increasingly greater with higher temperatures from 525°–1000° F., with the most significant increase in hardness occurring within this range at 1000° F. The inventors believe that the precise degree of heat hardening at given temperatures will vary with the differing compositions of the electrolytic solutions of the present invention.

Another advantage of the present invention is shown in Table 4. The thickness of chromium plated from the bath of Example I exceeds 300 microinches or about 8 μm, which is important in making a cutter element having suitable wear resistance properties. Prior trivalent baths only have been suitable for producing a thin, decorative chromium plate of less than about 200 microinches thickness. The bath of Example I electrodeposits chromium plating thicker than 200 microinches, preferably greater than 300 microinches, most preferably from about 300 to about 400 microinches.

EXAMPLE VI

Another plating bath was prepared that enables chromium to be deposited on a metal substrate thicker than from about 400–1000 microinches, and preferably greater than 900 microinches. The plating bath capable of plating chromium with these thicknesses is provided below in Table 5.

TABLE 5

| | g/L × 0.128 = ounces/gallon | |
|---|---|---|
| Trivalent Chromium | 48 | 6.14 |
| Iron Sulfate | 8 | 1.02 |
| Sulfate | 67 | 8.58 |

The trivalent chromium was produced by reducing chromic acid with methanol.

Using this bath chromium was deposited on a substrate having a thickness of about 25 μm. This thickness is about twice as thick as the best value obtained with the bath of Example I. Moreover, 25 μm is about eight-times as thick as the average chromium layer deposited.

EXAMPLE VII

Another plating bath was prepared, as in Example I, but the amounts of electrolytes, catalyst and buffer were varied such that the final composition of the bath was as shown in Table 6.

TABLE 6

| | g/L × 0.128 = ounces/gallon | |
|---|---|---|
| Trivalent Chromium | 47.4 | 6.1 |
| Hexavalent Chromium | 2.6 | 0.3 |
| Iron | 8.4 | 1.1 |
| Sulfate | 69.8 | 8.9 |

TABLE 7

| | | |
|---|---|---|
| Trivalent Chromium | 31.2–156.2 | 4–20 |
| Hexavalent Chromium | 0–156.2 | 0–20 |
| Iron | 3.9–11.7 | 0.5–1.5 |
| Sulfate | 69.5–198.4 | 8.9–25.4 |

Within these ranges, hexavalent chromium is preferably zero. Sufficient methanol should be added to eliminate substantially all hexavalent chromium from the bath.

EXAMPLE VIII

An effort was made to increase the brightness of the plated metal layers produced by compositions of the present invention. To this end, a new plating composition was formed having the components of Table 7 and including boric acid ($H_3BO_3$). A particularly preferred composition includes an amount of boric acid sufficient to substantially saturate the bath. A typical boric acid concentration was found to be about 39.1 g/L, although this amount can vary to about 10% below saturation, or from about 35 g/L to about 39 g/L. The components of this plating bath and their concentrations are shown in Table 8.

TABLE 8

| | g/L × 0.128 = ounces/gallon | |
|---|---|---|
| Trivalent Chromium | 47.7 | 6.1 |
| Hexavalent Chromium | 2.58 | 0.33 |
| Iron | 8.6 | 1.1 |
| Sulfate | 69.5 | 8.9 |
| Boric Acid ($H_2BO_3$) | 39.1 | 5.0 |

Excess methanol also was added to the bath to substantially reduce any remaining hexavalent chromium to trivalent chromium. After the addition of methanol, titrimetric analysis indicated that the plating solution contained no hexavalent chromium.

Plating tests using this bath showed that the addition of boric acid increased the brightness of the deposit. Hence, boric acid is preferably included in plating baths useful for the present invention in amounts sufficient to at least partially increase the brightness of the deposit.

EXAMPLE IX

Figure 6:
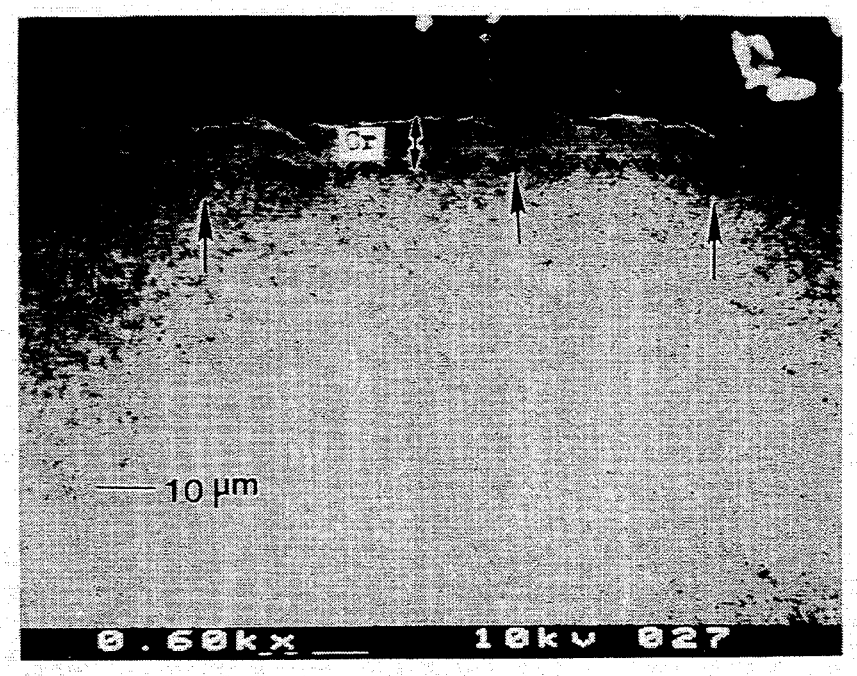
FIG. 6 is a cross-sectional view of a plated substrate showing substrate pitting.

FIG. 6 is a cross-sectional view of a plated substrate. The arrow in FIG. 6 indicates pitting that occurs on the surface of the substrate. Such pitting generally occurs at the bottom of cracks through the deposit. These cracks appear in deposits from hexavalent chromium plating compositions as well as trivalent chromium plating baths. In fact, the hexavalent bath appears to produce more deposit cracks than does the deposit from the trivalent chromium bath. Nevertheless, a new plating bath was formulated in an effort to reduce this pitting while maintaining or increasing the adherence of the deposit to the substrate.

Surprisingly, ammonium formate and sodium sulfate were found to substantially increase the quality of the deposit. As discussed in more detail in Example XII, potassium sulfate also appears to enhance adherence of the deposit to the substrate, although to a lesser degree than sodium sulfate. Without limiting the invention to one theory of operation, it is believed that the addition of ammonium formate provides a broader, bright-plating range, and increases the thickness of the metal deposit. Moreover, it appears that sodium sulfate increases the adherence of the deposit to the substrate.

Typically, ammonium formate is added to the plating composition at a concentration of from about 21 g/L to about 26 g/L. However, the concentration of ammonium formate appears to have a maximum value beyond which chromium sulfate may precipitate. This maximum concentration was found to be about 3 oz/gal, or about 23.4 g/L. Hence, a preferred ammonium formate concentration is about 23.4 g/L. Ammonium formate was added to the components shown in Table 8 to form a new plating composition as shown in Table 9.

TABLE 9

| | g/L × 0.128 = ounces/gallon | |
|---|---|---|
| Trivalent Chromium | 47.7 | 6.1 |
| Hexavalent Chromium | 2.58 | 0.33 |
| Iron | 8.6 | 1.1 |
| Sulfate | 69.5 | 8.9 |
| Boric Acid ($H_2BO_3$) | 39.1 | 5.0 |
| Ammonium Formate | 23.4 | 3.0 |

Figure 7:
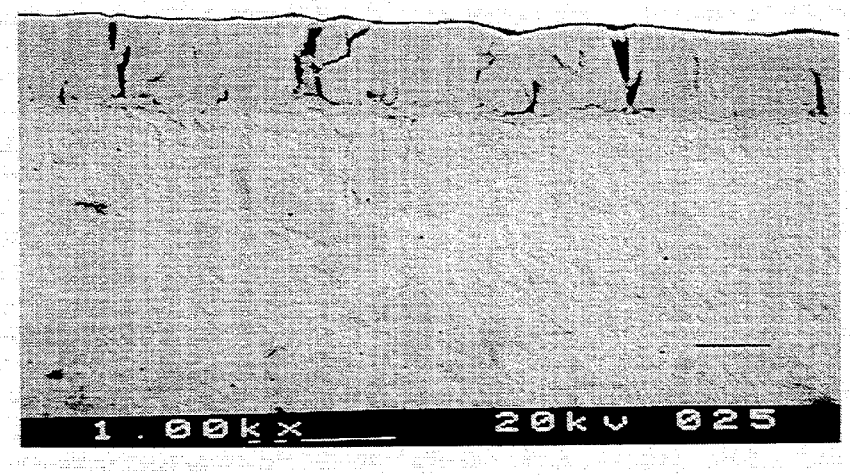
FIG. 7 is a cross-sectional view of a substrate showing reduced pitting when the substrate is plated according to the method of the present invention.

FIG. 7 is a cross-sectional view of a substrate plated with the composition of Table 9. FIG. 7 shows that this substrate had substantially reduced pitting to the substrate shown in FIG. 6. Hence, the addition of ammonium formate produces deposits of good quality wherein pitting of the substrate through cracks in the deposit is substantially eliminated.

EXAMPLE X

The concentration of sodium sulfate in the plating bath was increased to determine what effect such increase may have on the plating. In general, the sodium sulfate concentration was increased to a range of about 37 g/L to about 39 g/L. This specific example increased the sodium sulfate concentration up to about 38.5 g/L, although the sodium sulfate concentration has been found to be preferably about 37 g/L.

Using this plating bath, cutter elements were plated for heat treatment and shot peening. The plating conditions were as follows: cell voltage=about 7.6 volts;

current density=0.33 A/cm$^2$; reverse time, in seconds=15; plating time=4 or 8 minutes. The current was constant during the reverse period, but was pulsed at 0.5 Hz during plating. The samples were austempered and shot peened. The cutters produced by this method then were subjected to cutting tests to determine how their performance compared to platings achieved by hexavalent plating baths.

FIG. 5 shows that previous trivalent chromium baths plated substrates well, but that such substrates did not perform as well in cutting tests relative to substrates coated with hexavalent baths. However, cutters plated from baths having a sodium sulfate concentration of about 38.5 g/L did perform as well as substrates coated from hexavalent coating baths. Specifically, a displacement-to-failure test was performed on cutters plated as described herein. This test measures the amount of cutting a cutter can do before it is deemed to no longer cut effectively. Hence, the larger the number, the better the performance. The control value (the control was a substrate coated from a hexavalent plating bath, austempered and shot peened) for the displacement-to-failure test was 123, whereas cutters plated according to this Example had a value of about 133. The initial speed of the cutter also was measured, again with the faster speed reflecting a better performance. The control value for the initial speed was about 13.31, whereas the cutters plated according to this Example had values of from about 16 to about 17. Finally, the delta torque for the control and the cutter were compared. The control value was about 8.2, whereas cutters plated according to this Example had values of about 8.4, to about 9.2.

Hence, the data presented in Example X clearly shows that substrates plated with chromium and iron metal layers from a trivalent bath having a sodium sulfate concentration of about 38.5 g/L perform at least as well as substrates coated from hexavalent baths in cutting tests, and generally perform better than do substrates coated from hexavalent baths. This is in contrast to the data originally presented in FIG. 5, wherein it appears that substrates coated using hexavalent baths had slightly better performance characteristics than substrates coated using trivalent plating baths.

EXAMPLE XI

The plating composition described in Example VI was capable of achieving a plating thickness of approximately 25 μm. The thickness of the deposit was increased to about 80 μm by increasing the sulfate concentration up to about 67 g/L. This deposit had an iron concentration of about 30%.

Example IX established that the plating deposit thickness that can be achieved using a Cr(III) plating bath is increased by the addition of ammonium formate. Sodium sulfate appears to decrease the corrosion that occurs on the surface of the substrate. Hence, a new plating bath was formulated to determine to what extent the thickness of the chromium and iron deposit could be extended. The addition of increased amounts of sodium sulfate of from about 35 g/L to about 60 g/L, preferably about 37 g/L, increased the total sulfate concentration up to about from 140 g/L to about 180 g/L. A preferred composition has a total sulfate concentration of about 165 g/L. Without limiting the invention to one theory of operation, it is believed that sodium sulfate increases the conductivity of the solution and thereby facilitates electrodeposition of the chromium and iron metals.

The components of the composition and their concentrations are shown in Table 10.

TABLE 10

| | g/L | g/L × 0.128 = ounces/gallon |
|---|---|---|
| Trivalent Chromium | 47.7 | 6.1 |
| Hexavalent Chromium | 0.00 | 0.00 |
| Iron | 8.6 | 1.1 |
| Sulfate | 165 | 21.1 |
| Boric Acid ($H_2BO_3$) | 39.1 | 5.0 |
| Ammonium Formate | 23.4 | 3.0 |

The concentration of hexavalent ions was shown to be substantially zero percent by colorimetric analysis. Using this plating bath, low carbon steel wires having a diameter of about 1.6 mm and a length of about 20 cm were plated at room temperature. The conditions for this plating experiment were as follows: the cell voltage was about 5.4 volts; the current density was about 0.37 A/cm$^2$; the current was pulsed at ½ Hz; and the plating rate was about 0.65 μm/min. Under these conditions, low carbon steel wire substrates were plated having a 20 μm layer, a 40 μm layer, and a 160 μm layer.

Figure 8:
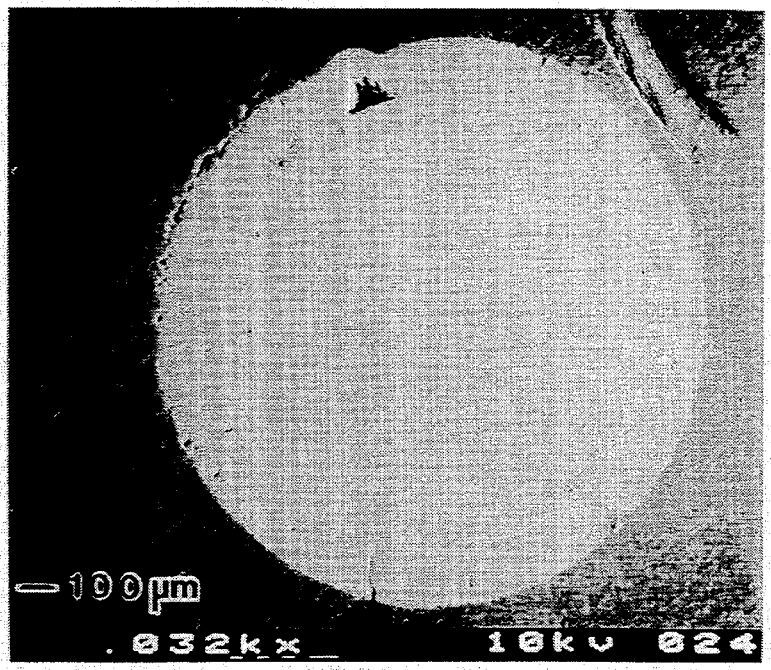
FIG. 8 is a cross-sectional view of a substrate plated according to the present invention having a plating thickness of about 150 μm.

FIG. 8 shows a cross-sectional view of a low carbon steel substrate plated with this bath. FIG. 8 also shows that the substrate can be plated with a deposit having a thickness of up to about 160 μm. The arrow in FIG. 8 points to a large defect in the deposit. However, the adherence of the remainder of the deposit to the substrate is very good.

Figure 9:
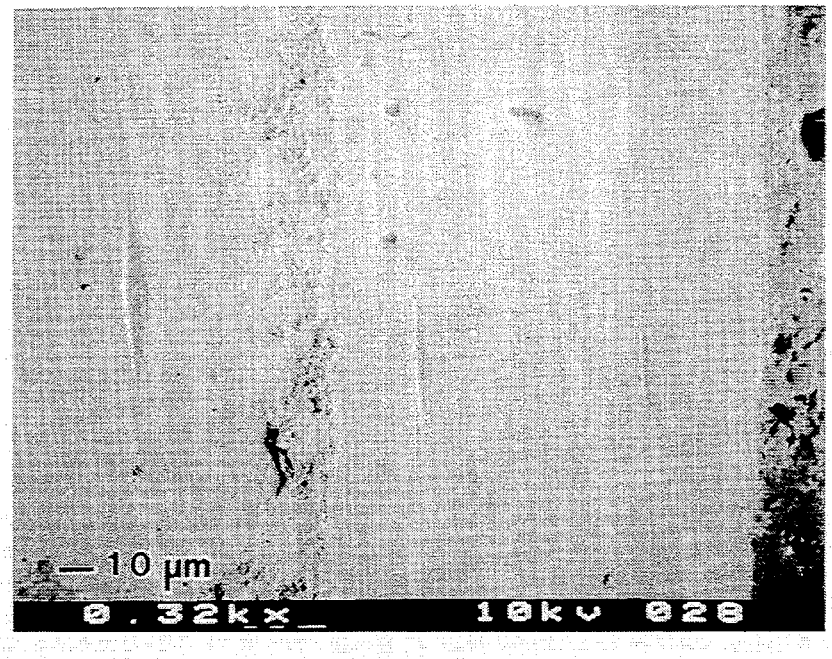
FIG. 9 is an enlargement of the plated substrate of FIG. 8.

FIG. 9 is an enlargement of the deposit shown in FIG. 8. FIG. 9 shows details of the deposit and the indentations made when the hardness of the steel wire was tested with a 100 gram load. The deposit was indented to a lesser extent than was the wire substrate as would be expected.

The hardness of thick deposits on steel wire substrates was determined after heat treatment. The as-plated hardness was about 775 KHN at a load of about 50 grams. The KHN for the deposit increased up to about 1600 KHN after heating at a temperature of about 600° C. Heating the plated substrate to a temperature of about 700° C. decreased the KHN to about 1200. This value remained fairly constant when the heating temperature was increased above about 700° C. Hence, it appears that a preferred temperature for heat-treating thick deposits, as opposed to heat treating the entire composite, is about 600° C. for achieving maximum hardness of the chromium metal layer.

Figure 13:
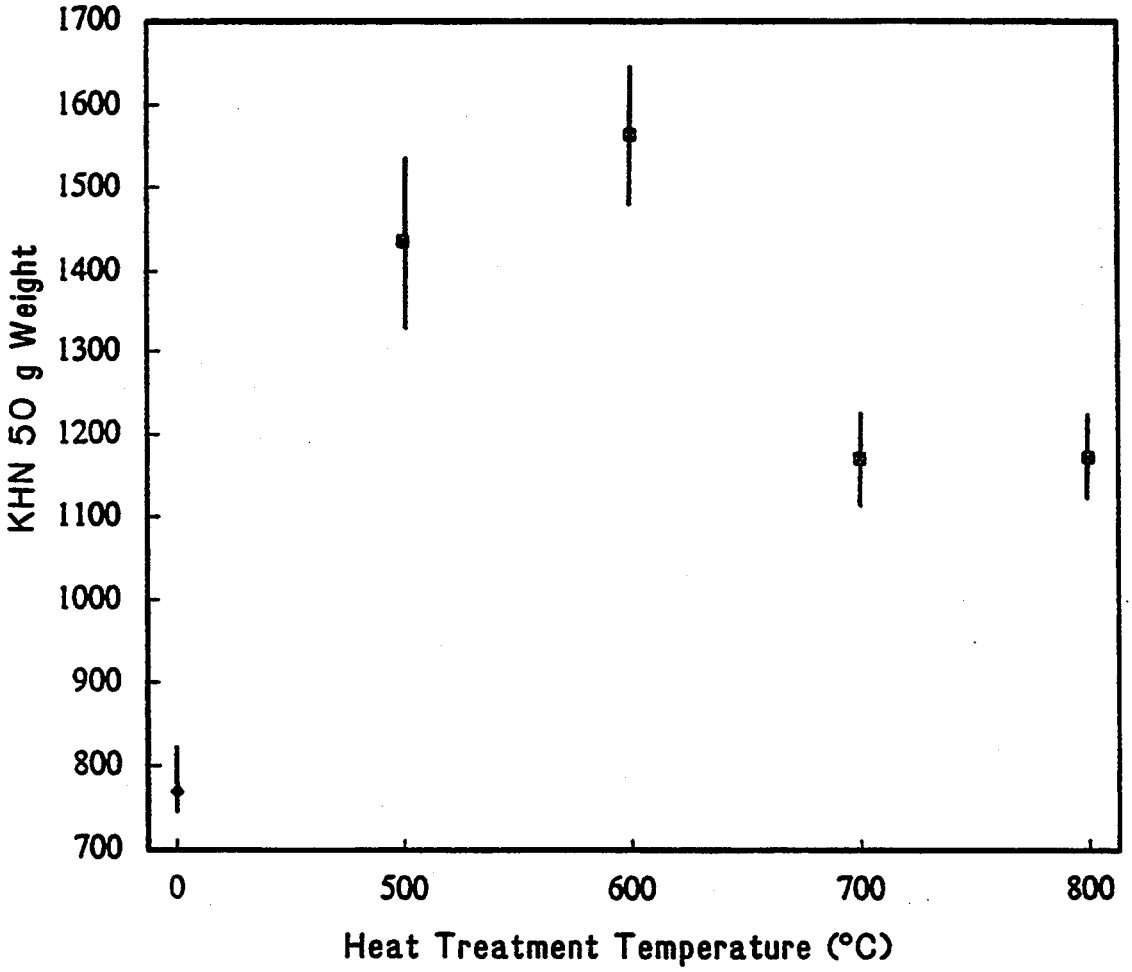
FIG. 13 is a graph showing the Knoop Hardness Numbers after heat treating deposits having thicknesses of 40 μm and 100 μm.

FIG. 13 is a graph showing the data discussed in the preceding paragraph. FIG. 13 shows the Knoop Hardness Numbers at a 50-gram-weight load versus the heat-treatment temperature for chromium and iron metal deposits after heating for about 30 minutes at the indicated temperatures, followed by air cooling. The data at each temperature are for four tests, two on deposits of 40 μm thickness and two on deposits of 100 μm thickness. This graph clearly shows that the Knoop Hardness Number increases with increasing temperature up to about 600° C. Thereafter, the Knoop Hardness Number decreases until it reaches a steady number of about 1200 after a temperature of about 700° C.

The actual mechanism which allows the plated product of the trivalent bath to harden with heating is unknown. The inventors believe, however, that formic acid is generated in the bath by the partial decomposition of methanol which is added as a reducing agent. Formic acid formation is believed to result in co-deposition of carbon in the electroplated deposit that allows heat hardening to occur. The trivalent chromium may be complexed with carbon, and hence organic.

Figure 10:
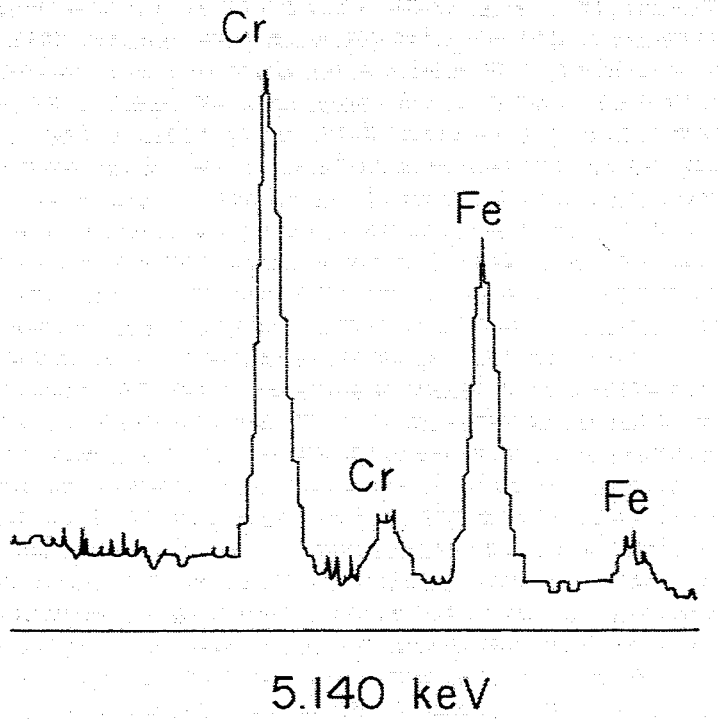
FIG. 10 is an EDS spectrum showing the composition of the deposit of FIGS. 8 and 9.

An energy dispersive spectrometer (EDS) was used to analyze the chemical composition of the plating bath and deposits. More particularly, X-ray fluorescence using an EDS attached to a scanning electron microscope provided information about the quality and composition of the plating bath and deposits therefrom. A preferred EDS was a LINK AN 10000 energy dispersive spectrometer, attached to an ISI SS 40 scanning electron microscope. An EDS spectra was taken of the deposit shown in FIG. 9. This EDS spectrum is shown in FIG. 10, and indicates that an area of about $2.5\times10^{-5}$ cm$^2$ surrounding the indentations in the deposit of FIG. 9 contains about 60% chromium and about 40% iron.

EXAMPLE XII

The data presented in this Example concerns whether or not the source of sulfate catalyst could be varied while maintaining the quality of the deposits described above. In this Example, potassium sulfate was substituted for sodium sulfate. The components of this plating composition and their concentrations are shown in Table 11.

TABLE 11

| | g/L × 0.128 = ounces/gallon | |
|---|---|---|
| Trivalent Chromium | 47.7 | 6.1 |
| Hexavalent Chromium | 0.0 | 0.0 |
| Iron | 8.6 | 1.1 |
| Potassium Sulfate | 37.0 | 4.74 |
| Boric Acid ($H_3BO_3$) | 39.1 | 5.0 |
| Ammonium Formate | 23.4 | 3.0 |

When potassium sulfate was substituted for sodium sulfate it was found that a good deposit was achieved having a thickness of up to about 50 μm. Hence, it appears that potassium sulfate can be substituted for sodium sulfate and obtain a good quality deposit. However, it was surprisingly found that substituting potassium sulfate for sodium sulfate produced plating deposits wherein thicknesses greater than about 50 μm did not adhere as well to the substrate. Hence, without limiting the invention to one theory of operation, it appears that sodium sulfate enhances the ability of the plating composition to achieve deposits of greater than about 50 μm, and up to about 160 μm. Defects through the deposit to the outer surface of the substrate occur, both with sodium and potassium sulfate. However, when potassium sulfate is used, and deposits greater than about 50 μm thickness are plated, then the substrate appears to corrode to a greater extent beneath the deposit.

The effect of the chromium-to-sulfate ratio also was investigated. Through several experiments, it was found that a preferred chromium-to-sulfate ratio is approximately 31.5 g/L to about 165 g/L. However, it is also believed that these values can be varied approximately ±10% and still achieve a plating that has excellent thickness and adherence.

EXAMPLE XIII

By varying the ratio of the iron-to-chromium, such as by varying the amounts of iron sulfate added to the plating composition, it has been found that varying percentages of iron and chromium metal can be co-deposited on a substrate. This is a surprising result because those skilled in the art have long believed that the plating ability of a chromium plating composition was adversely affected by the addition of iron, regardless if the bath is a trivalent-chromium or hexavalent-chromium bath. However, it has now been determined that the addition of an inorganic iron compound, preferably iron sulfate, to the trivalent plating baths of the present invention provides a composition that is capable of plating various combinations of chromium and iron metal onto a substrate. Hence, it now is possible to produce deposits having a chromium content ranging from more than about 90% and iron content less than about 10%, to deposits having a chromium content less than about 10% and iron content more than about 90%.

It is important to note that the ability to select the amount of iron and chromium co-deposited on a workpiece allows a workpiece to be plated with stainless steel. Stainless steel is an alloy of iron and chromium. The minimum amount of chromium needed to constitute stainless steel is about 12%. Hence, the present invention provides a method for electroplating workpieces with stainless steel.

Figure 11:
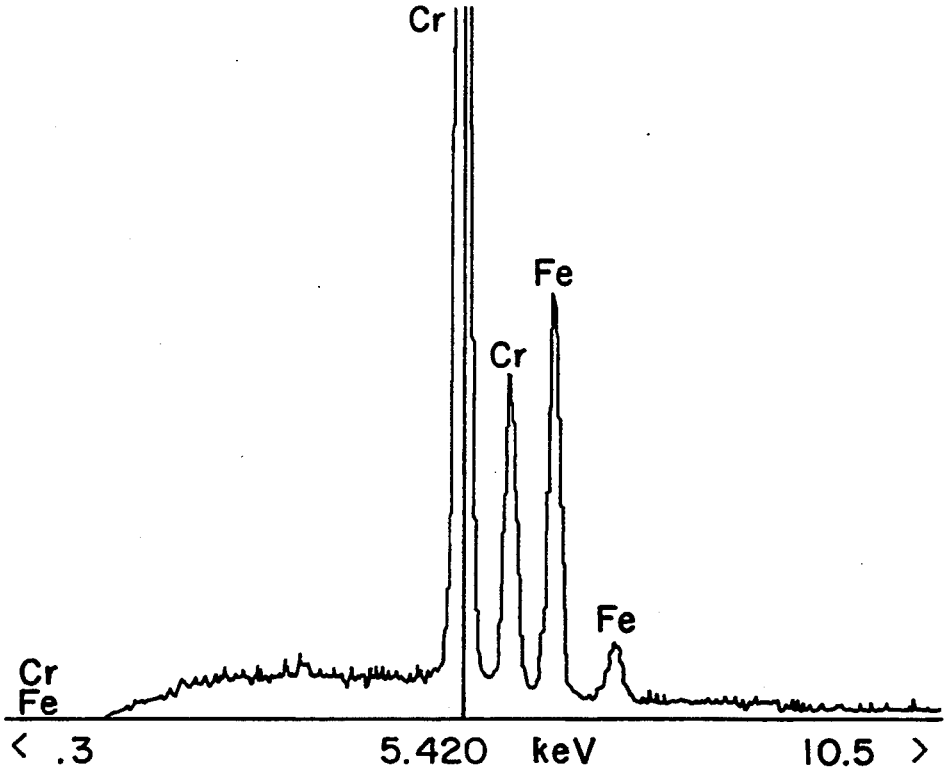
FIG. 11 is an EDS spectrum of a deposit containing about 14% Fe and 86% Cr.
Figure 12:
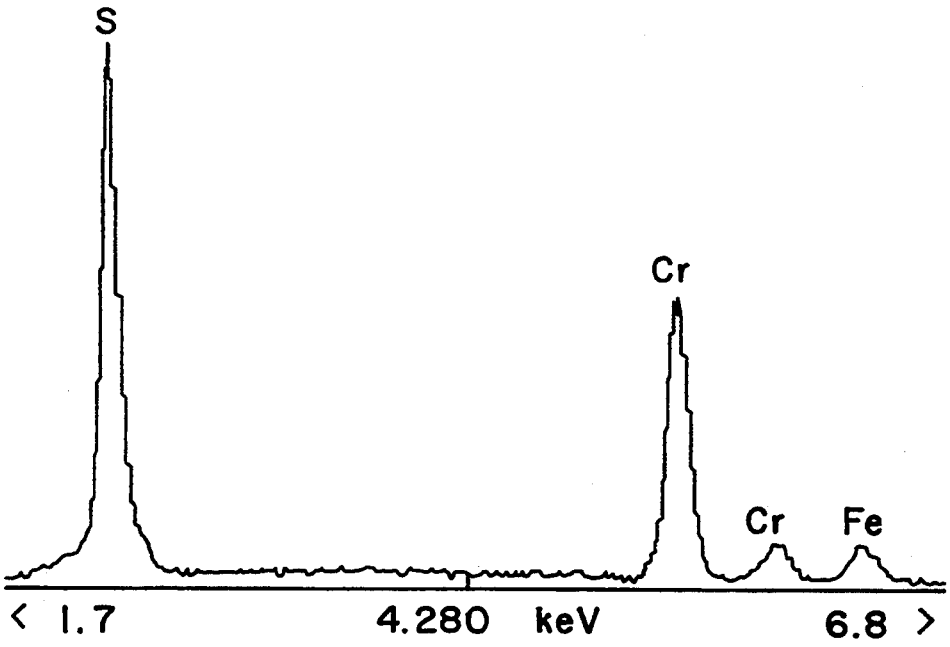
FIG. 12 is an EDS spectrum showing the composition of the plating solution that produced the deposit of FIG. 11.

FIG. 11 shows an EDS spectra from a deposit containing about 86% chromium and about 14% iron. FIG. 12 shows an EDS spectrum from a drop of the plating solution used to produce this deposit. By comparing the two EDS spectrums, it can be noted that the ratio of chromium in the deposit to chromium in the plating bath is about 2.4, and that the corresponding ratio of iron in the deposit to iron in the plating bath is about 2.8. Thus, iron appears to deposit more readily than does chromium. The bath producing the EDS spectrum of Fig. 12 had about 59% sulfate, about 36% trivalent chromium and about 5% iron.

The plating conditions for producing the plated workpiece of FIG. 11 were: current density=0.8 A/cm$^2$; pulse frequency=0.5 Hz; plating time=10 minutes, starting with a 10-second, reverse-constant current; and the plating tank contained about 4.0 liters of plating solution at a pH of about 1.36. The as-plated hardness of the deposit was about 403 KHN at a load of about 25 grams. The workpiece then was heated in a nitrogen atmosphere for 20 minutes at a temperature of about 800° C., followed by air cooling. The KHN value after such heating increased to about 1300 KHN at a load of about 25 grams.

Figure 14:
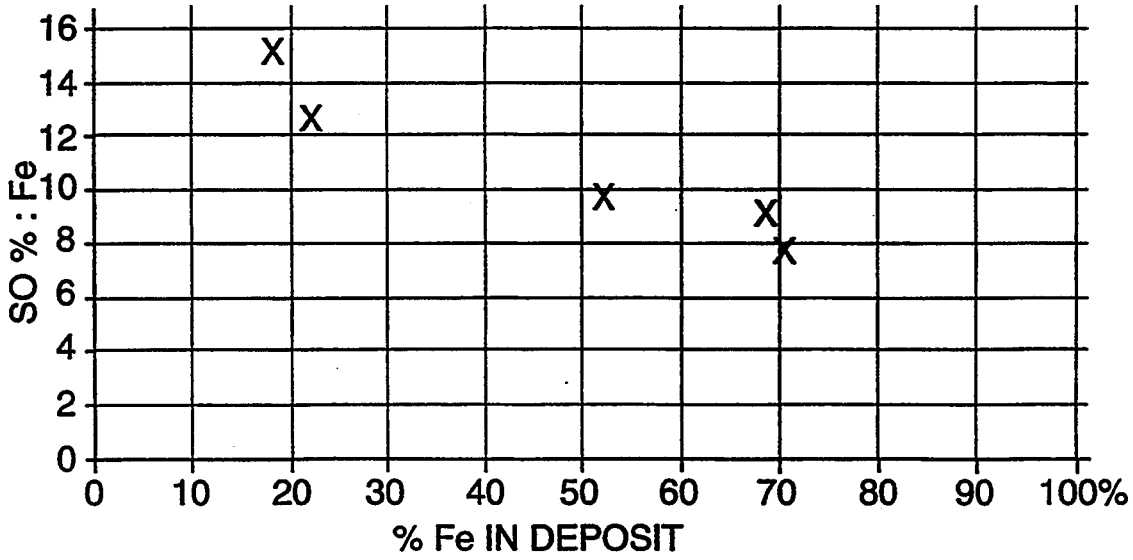
FIG. 14 is a graph showing the percent of iron deposited by varying the sulfate-to-iron ratio in the plating bath.

By increasing the iron content of the plating bath, it is possible to obtain good quality deposits over a wide range of compositions. FIG. 14 is a graph showing the amount of iron deposited by varying the sulfate-to-iron ratio in the plating composition. FIG. 14 clearly shows that the iron content can be varied from about 18% to about 70%. Table 12 shows the percent iron deposited by varying the sulfate-to-iron ratio.

Figure 15:
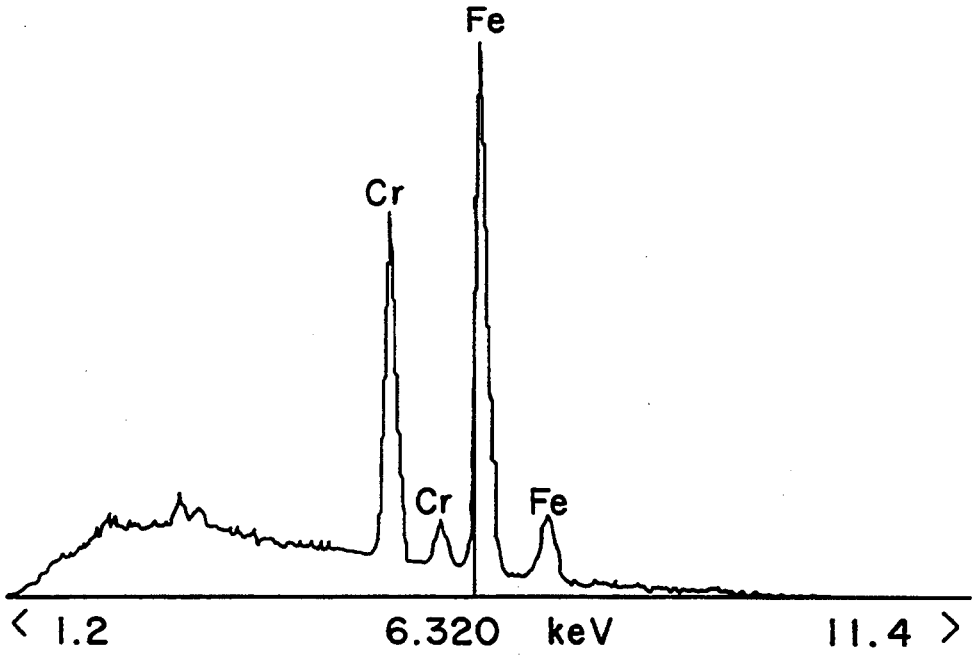
FIG. 15 is an EDS spectrum showing the composition of a deposit on a cutter.

FIG. 15 is an EDS spectra showing the composition of a deposit made on a cutter element. FIG. 15 clearly shows that the chromium metal content of the deposit is about 40%, whereas the iron content is about 60%. Hence, the results shown in FIGS. 14 and 15, and Table 12, clearly demonstrate that the present invention provides a method for plating workpieces with various percentages of iron and chromium by adjusting the sulfate-to-iron ratio in the plating bath. The sulfate-to-iron ratio was chosen because the sulfate concentration can be determined quickly and relatively accurately using X-ray fluorescence spectrometry. Table 12, along with the discussion provided above concerning producing trivalent chromium plating compositions, provides sufficient detail to enable one skilled in the art to produce a bath wherein the bath is capable of co-depositing a desired amount of iron and chromium metals. For example, if a Cr:Fe ratio of about 30:70 is desired, then the sulfate to iron ration should be about 5.80. To achieve this ratio, the plating bath was formulated to have the preferred concentrations of the ingredients other than iron sulfate. The iron-to-sulfate ratio was then adjusted to the levels stated in Table 12 by the addition of increasing amounts of iron sulfate.

TABLE 12

| Percent Iron | $SO_4$:Fe |
|---|---|
| 18.8 | 15.06 |
| 22.4 | 12.70 |
| 52.4 | 9.72 |
| 68.2 | 8.94 |
| 70.4 | 5.80 |

Another aspect of preferred embodiments of the present invention is the use of a non-reactive anode, such as platinum plated over a titanium mesh. Lead anodes were used in the prior art, but have been found to change the chemical equilibrium of the bath. These changes produce a sludge that fouls the anode and requires frequent cleaning or replacement of the anode. Moreover, nonreactive anodes do not oxidize $Cr^{3+}$ to $Cr^{6+}$, as well as lead, and therefore avoid production of $Cr^{6+}$ that then contaminates the bath. The platinum anode diminishes loss of $Cr^{3+}$ by oxidation at the anode.

The present invention is suitable for plating many types of cathode substrates, including nickel, low-carbon steel, iron, copper and others. Temperatures and times of heating the substrates will vary interdependently depending on the particular electrolytic bath employed. A reducing agent other than methanol, for example formic acid, is suitable for reducing Cr(VI) to Cr(III) in the practice of this invention. As used herein, the term "substantially free of hexavalent chromium ions" refers to an electrolytic solution having less than about 2.6 g/L hexavalent chromium, or wherein the ratio of the concentration of the trivalent to hexavalent species is 18 to 1 or greater. The temperature of the electrolytic bath during plating is maintained at between about 60°-140° F., and preferably between 60°-70° F. Finally, although the present invention contemplates eliminating the necessity for removing oxidation products from an unplated heated substrate, cleansing of the substrate prior to plating can still occur within the scope of this invention.

Having illustrated and described the principles of the invention in several preferred embodiments, it should be apparent to those skilled in the art that the invention can be modified in arrangement and detail without departing from such principles. I claim all modifications coming within the spirit and scope of the following claims.

I claim:

1. A method for electroplating a workpiece, comprising:

providing a plating bath comprising (a) trivalent chromium produced by reducing a Cr(VI) compound to Cr (III) with methanol or formic acid, (b) ammonium formate, (c) an inorganic iron compound, (d) a sulfate catalyst, and (e) a sufficient amount of sulfuric acid to provide a bath pH of from about 0.5 to about 1.5, wherein the bath being maintained substantially free of hexavalent chromium ions by the addition of sufficient amounts of methanol or formic acid;

providing an anode in the plating bath;

placing the workpiece in the bath to act as a cathode;

electroplating a chromium and iron metal layer onto the workpiece by passing an electric current through the plating bath; and heating the workpiece from about 600° F. to about 1675° F. for a sufficient period of time to harden the workpiece while retaining or increasing hardness of the chromium alloy plated on the workpiece.

2. The method according to claim 1 wherein the total sulfate concentration is from about 140 g/L to about 180 g/L.

3. The method according to claim 2 wherein the total sulfate concentration is about 165 g/L.

4. The method according to claim 2 wherein the total sulfate concentration includes sodium sulfate at a concentration of from about 35 g/L to about 60 g/L.

5. The method according to claim 1 wherein the plating bath further includes a sufficient amount of boric acid to increase the brightness of the deposit.

6. The method according to claim 5 wherein the plating bath is saturated with boric acid.

7. The method according to claim 6 wherein the bath consists essentially of from about 28 g/L to about 35 g/L trivalent chromium, from about 10 g/L to about 12 g/L inorganic iron compound, from about 21 g/L to about 26 g/L ammonium formate, from about 140 g/L to about 180 g/L total sulfate concentration wherein about 35 g/L to about 60 g/L is contributed by sodium sulfate, a sufficient amount of boric acid to substantially saturate the bath, and a sufficient amount of sulfuric acid to provide a bath pH of from about 1.0 to about 1.5.

8. The method according to claim 1 wherein the bath comprises from about 28 to about 35 g/L trivalent chromium, from about 10 to about 12 g/L inorganic iron compound, from about 21 to about 26 g/L ammonium formate, and from about 140 g/L to about 180 g/L total sulfate of which from about 35 g/L to about 60 g/L is contributed by sodium sulfate.

9. The method according to claim 8 wherein the bath comprises about 31.5 g/L trivalent chromium, about 11.4 g/L iron sulfate, about 23.4 g/L ammonium formate, and about 37 g/L sodium sulfate.

10. The method according to claim 1 wherein the step of electroplating comprises providing a current density of from about 0.8 to about 6.5 $A/in^2$.

11. The method according to claim 1 wherein the step of heating the workpiece comprises heating the workpiece from a temperature of from about 600° to about 1000° F.

12. The method according to claim 1 wherein the workpiece is a cutter.

13. The method according to claim 1 wherein the step of electroplating comprises electroplating the workpiece with a chromium and iron metal layer having a thickness of up to about 160 $\mu$m.

14. The method according to claim 1 wherein the amount of iron deposited can be determined from a percentage of from about 10% iron to about 90% iron by adjusting the amount of iron in the bath.

15. A method for plating a workpiece, comprising the steps of:

providing a plating bath comprising (a) from about 28 g/L to about 35 g/L trivalent chromium produced by reducing a Cr(VI) compound to Cr(III) with methanol or formic acid, the bath thereafter being substantially free of hexavalent chromium ions, (b) from about 10 g/L to about 12 g/L of iron introduced by an inorganic iron compound, (c) from about 21 g/L to about 26 g/L ammonium formate, (d) from about 140 g/L to about 180 g/L total sulfate wherein the total sulfate concentration includes a sufficient amount of sulfuric acid to provide a bath pH of from about 0.5 to about 1.5;

providing an anode in the plating bath;

placing a workpiece in the bath to act as a cathode;

electroplating a chromium and iron metal layer onto the workpiece by passing an electric current through the bath; and heating the workpiece from about 600° F. to about 1675° F. for a sufficient period of time to harden the workpiece while retaining or increasing hardness of the chromium alloy plated on the workpiece.

16. The method according to claim 15 wherein the total sulfate concentration includes iron sulfate, sodium sulfate, and sulfuric acid, and the total sulfate concentration is from about 140 g/L to about 180 g/L.

17. The method according to claim 16 wherein the bath is saturated with boric acid.

18. The method according to claim 17 wherein the bath comprises about 31.5 g/L trivalent chromium, about 11.4 g/L iron sulfate, about 23.4 g/L ammonium formate, and about 37 g/L sodium sulfate.

19. The method according to claim 18 wherein the step of electroplating comprises plating the workpiece with a chromium and iron metal layer having a thickness of up to about 160 μm.

20. A method for electroplating a workpiece, comprising the steps of:

providing a plating bath comprising (a) about 31.5 g/L trivalent chromium produced by reducing a Cr(VI) compound to Cr(III) with methanol or formic acid, the bath thereafter being substantially free of hexavalent chromium ions, (b) about 11.4 g/L iron sulfate, (c) about 23.4 g/L ammonium formate, (d) about 165 g/L total sulfate wherein the total sulfate includes amounts contributed by about 37 g/L sodium sulfate and a sufficient amount of sulfuric acid to provide a bath p H of from about 1.0 to about 1.5, and (f) a sufficient amount of boric acid to substantially saturate the bath with boric acid;

providing an anode in the plating bath;

placing a workpiece in the bath to act as a cathode; and electroplating a chromium and iron metal layer onto the workpiece by passing an electric current through the plating bath wherein the layer has a thickness of from about 5 μm to about 160 μm, the layer exhibiting the property of maintaining or increasing its hardness when subjected to heat treatment at a temperature of from about 600° F. to about 1675° F.

21. The method according to claim 20 and including the step of heating the workpiece, after the step of electroplating, to a temperature of from about 600° F. to about 1000° F.

22. A method for electroplating a workpiece with a chromium and iron metal layer so that the iron concentration in the metal layer is from about 10 percent to about 90 percent, the method comprising the steps of:

providing a plating bath comprising (a) trivalent chromium compound produced by reducing Cr(VI) present in the bath to Cr(III) by the addition of sufficient amounts of methanol or formic acid, the bath thereafter being substantially free of hexavalent chromium ions, (b) an inorganic iron compound, (c) a sulfate catalyst, (d) ammonium formate, and (e) a sufficient amount of sulfuric acid to provide a bath pH of from about 0.5 to about 1.5, wherein the amount of iron in the bath is selected to provide the desired amount deposited in the layer;

providing an anode in the plating bath;

placing a workpiece in the bath to act as a cathode;

electroplating the workpiece with a chromium and iron metal layer having an iron concentration of from about 10 percent to about 90 percent by passing an electric current through the plating bath; and heating the workpiece from about 600° F. to about 1675° F. for a sufficient period of time to harden the substrate while retaining or increasing hardness of the chromium alloy plated on the workpiece.

23. The method according to claim 22 wherein the bath further includes an amount of boric acid sufficient to substantially saturate the bath.

24. The method according to claim 22 wherein the layer has about 60% to about 90% chromium.

25. The method according to claim 22 and further including the step of heating the workpiece, after the step of electroplating, from a temperature of from about 600° F. to about 1000° F.

26. An electroplating bath for plating a metal article with a chromium alloy layer having a thickness of from about 5 μm to about 160 μm, the layer maintaining or increasing its hardness when subjected to heat treatment at a temperature of from about 600° F. to about 1675° F., consisting essentially of:

from about 28 g/L to about 35 g/L trivalent chromium produced by reducing Cr(VI) to Cr(III) by additions of sufficient amounts of methanol or formic acid, the bath thereafter being substantially free of hexavalent chromium ions;

from about 10 g/L to about 12 g/L inorganic iron compound;

from about 21 g/L to about 26 g/L ammonium formate;

from about 140 g/L to about 180 g/L total sulfate;

a sufficient amount of sulfuric acid to provide a bath pH of from about 0.5 to about 1.5; and an amount of boric acid sufficient to substantially saturate the bath.

27. The bath according to claim 26 wherein the bath consists essentially of:

from about 28 g/L to about 35 g/L trivalent chromium produced by substantially completely reducing Cr(VI) to Cr(III) by the addition of sufficient amounts of methanol or formic acid;

from about 10 g/L to about 12 g/L iron;

from about 21 g/L to about 26 g/L ammonium formate;

from about 37 g/L to about 60 g/L sodium sulfate;

a sufficient amount of sulfuric acid to provide a bath pH of from about 0.5 to about 1.5, wherein the total sulfate concentration is from about 140 g/L to about 180 g/L; and an amount of boric acid sufficient to substantially saturate the bath.

28. An electroplating bath for plating a metal article with a chromium alloy layer, the layer maintaining or increasing its hardness when subjected to heat treatment at a temperature of from about 600° F. to about 1675° F. consisting essentially of:

about 31.5 g/L trivalent chromium produced by reducing Cr(VI) to Cr(III) by adding to the bath sufficient amounts of methanol or formic acid, the bath thereafter being substantially free of hexavalent chromium ions;

about 11.4 g/L inorganic iron compound;

about 23.4 g/L ammonium formate;

about 37 g/L sodium sulfate;

a sufficient amount of sulfuric acid to provide a bath pH of about 1.0 to about 1.5; and an amount of boric acid sufficient to substantially saturate the bath.

* * * * *

UNITED STATES PATENT AND TRADEMARK OFFICE

CERTIFICATE OF CORRECTION

PATENT NO. : 5,413,646

DATED : May 9, 1995

INVENTOR(S) : John Dash and John DeHaven

It is certified that error appears in the above-identified patent and that said Letters Patent is hereby corrected as shown below:

Column 7, line 43, "hardenable" should read --heat hardenable--;

Column 12, line 51, "pitting to the" should read --pitting compared to the--; and Column 19, line 46, "p H" should read --pH--.

Signed and Sealed this

Third Day of October, 1995

*Attest:*

*Attesting Officer*

BRUCE LEHMAN

*Commissioner of Patents and Trademarks*